United States Patent [19]

Thalenfeld

[11] Patent Number: 5,060,897

[45] Date of Patent: Oct. 29, 1991

[54] TWO-PART SWIVEL HOOK WITH SAFETY MOUNTING

[75] Inventor: David R. Thalenfeld, Bear Creek, Pa.

[73] Assignee: Trion Industries Inc., Wilkes-Barre, Pa.

[21] Appl. No.: 554,699

[22] Filed: Jul. 18, 1990

[51] Int. Cl.[5] ..... F16B 45/00

[52] U.S. Cl. ..... 248/220.4; 211/57.1; 211/59.1; 248/304

[58] Field of Search ..... 248/220.2, 220.4, 220.3, 248/222.1, 223.1, 222.4, 304, 303, 225.1, 225.2, 309.2; 211/57.1, 59.1

[56] References Cited

U.S. PATENT DOCUMENTS 4,526,335 7/1985 Garfinkel ..... 211/57.1 X 4,706,917 11/1987 Thalenfeld ..... 248/225.2 X

FOREIGN PATENT DOCUMENTS 1483450 10/1977 United Kingdom ..... 248/220.4

*Primary Examiner*—Carl D. Friedman

*Assistant Examiner*—Derek J. Berger

*Attorney, Agent, or Firm*—Schweitzer, Cornman & Gross

[57] ABSTRACT

A two-part swivelling display hook is disclosed, which includes a base member, adapted to be mounted on a shelf, panel or other display fixture, and wire-like merchandise display arm mounted on the base member for swivelling movement about a generally vertical axis. The base member is formed of sheet metal, configured to provide an upper guide portion, a front wall having a punched out and inwardly bent integral lower guide portion, and a bottom support portion. The display member, provided with a vertical mounting porition, is inserted in openings provided in the guide portions and is supported on the lower support portion, which also protects the lower end of the wire against accidental user contact. A staked key, formed on the mounting portion of the display element, is received in a radial slot for initial assembly, but is prevented thereafter from swivelling into alignment with such slot, so that the device is permanently assembled.

8 Claims, 1 Drawing Sheet

TWO-PART SWIVEL HOOK WITH SAFETY MOUNTING

BACKGROUND AND SUMMARY OF THE INVENTION

The present invention relates to merchandise display hooks, and more particularly to a two-part swiveling display hook which includes a base member, adapted to be mounted on a shelf, panel or other display fixture, and a wire-like merchandise display arm, which is mounted on the base member for swiveling movement about a predetermined axis, typically vertical, but possibly slightly angled from the vertical.

It is known in the prior art to assemble two-part swivel hooks of the above described type by forming the wire-like display hook element to have a generally vertical mounting portion, which extends through aligned openings in the base member. The lower end of the vertical mounting portion is "staked" or otherwise deformed so that, after assembly, the two parts cannot be separated. A common manufacturing technique for this purpose involves staking of the wire element after assembly of the wire element to the base. The parts are then permanently joined.

U.S. Pat. No. 4,871,135, granted to Trion Industries Inc., illustrates a two-part swivel hook arrangement in which the wire-like display element is staked at the lower end of its mounting portion prior to assembly with the base member, and the base member is designed to receive the staked wire element only in a predetermined rotational orientation, which orientation is not permitted in the normal functioning of the device. Thus, in the patented device, while it is possible to separate the two parts after assembly, it requires demounting of the hook and performing special operations in order to do so, which is desired in order to prevent unauthorized and/or unattended disassembly.

The present invention is directed to the general type of two-part swivel hook assembly, in which the mounting portion of the wire-like display hook member is staked prior to its assembly with the base. In addition, and as a significant feature of the invention, the base member is so designed and configured as to completely conceal and protect the lower end extremity of the wire mounting portion, thus preventing any accidental contact with that portion by a person's hand. In the device of the present invention, the hook and mounting arrangement is uniquely designed so that a portion of the sheet metal base member underlies the raw end of the hook mounting portion, so as to preclude any contact.

In the display hook of the invention, a sheet metal base member has a generally horizontally disposed U-shaped or J-shaped configuration, forming an upper guide portion and a lower support portion. Intermediate these portions, a tab-like section of the sheet metal base member is punched out to form a lower horizontal guide portion. The upper and lower guide portions are provided with openings for the reception of the vertical mounting portion of the wire display element, with the lower extremity of the wire mounting portion resting upon and being supported by the horizontally disposed lower support portion of the base member. In addition to concealing and protecting the lower extremity of the wire mounting portion, the lower support allows the outwardly extending, merchandise support portion of the display element to be disposed at a convenient level above the top of the base member. This is important where, as is fairly typical, the device is mounted on the front edge of a shelf and projects outward into the aisle space.

Pursuant to the invention, the wire mounting portion is staked before assembly to the base member, and the wire receiving openings formed in the guide portions of the base member are of a "keyhole" configuration. The orientation of the keyhole openings is such, in relation to the orientation of the staked "key" on the mounting portion of the display element, that the display element is required to be rearwardly oriented—that is approximately 180° away from the normal display position—in order to be able to assemble the display element into the base member. Appropriate means are provided to thereafter prevent or impede the display elements from being positioned in the assembly orientation, in order to prevent subsequent unintended disassembly of the device. In many cases, such means comprises a label holder or similar device fixed to the base member in obstructing relation to the display element. In other cases, the presence of merchandise cards, for example, may be relied upon to prevent unintended disassembly.

For a more complete understanding of the above and other features and advantages of the invention, reference should be made to the following detailed description of a preferred embodiment of the invention and to the accompanying drawings.

DESCRIPTION OF A PREFERRED EMBODIMENT

Figure 1:
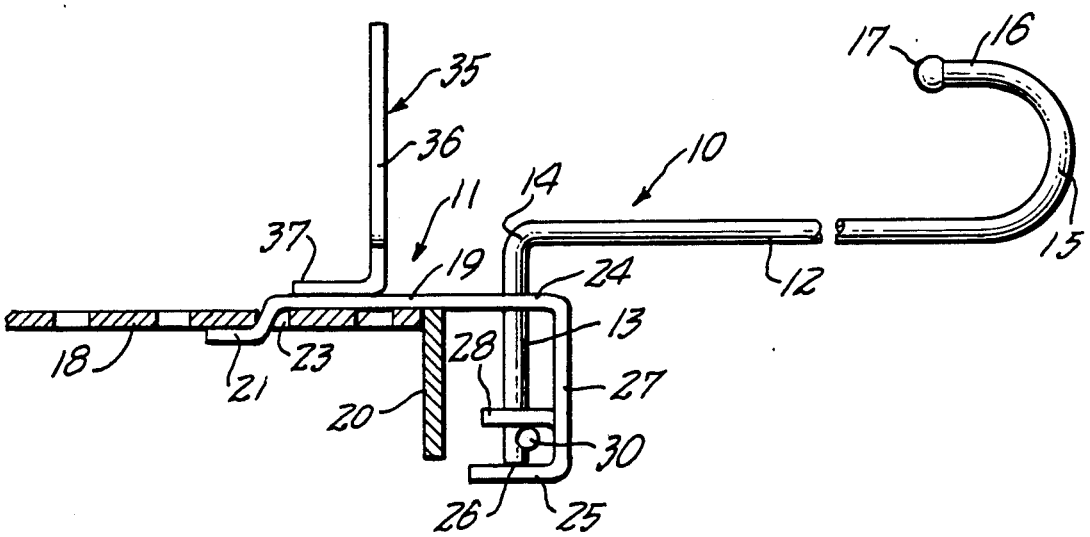
FIG. 1 is a side elevational view of the hook assembly of the invention, shown mounted on a display shelf.

Referring now to the drawing, and initially to FIG. 1 thereof, the reference numeral 10 designates a merchandise display element, forming one part of a two-part swivel hook assembly. The reference numeral 11 designates generally the second part, namely the base member. The display element 10 includes a generally horizontally directed support portion 12, used for hanging carded merchandise or the like. At its inner end, the support portion 12 joins with a generally vertically disposed mounting portion 13, by means of a relatively sharp bend 14 in the wire. The outer end of the display element is bent upwardly and rearwardly through 180° bend, of a relatively large radius, for example of about ½ inch, to form a rounded outer end portion 15. To particular advantage, the rearwardly directed portion 16 at the forward end extremity of the wire terminates in a balled end 17. This is a unique feature in a reversely bent hook, which forms the subject matter of a related copending application Ser. No. 07/578,584, filed by Thomas O. Nagel for "Method and Apparatus for the Manufacture of J-shaped Display Hooks with Balled Ends", owned by Trion Industries Inc.

In the illustrated form of the invention, the mounting bracket 11 is adapted for mounting at the front of a display shelf 18. However, it will be understood that the bracket may be configured for mounting on a vertical, apertured display panel, for example, or in other ways or other types of display fixtures.

To advantage, the base member 11 is formed of a sheet metal material, typically about 1/16 inch in thickness and for example one inch to an inch and a quarter in width. The base member includes a flat body portion 19, the rearward portion of which overlies the top surface of the shelf 18, and the forward portion of which projects outwardly of the front edge 20 of the shelf, in cantilever fashion. At its rearward extremity, the body portion 19 has a pair of integral, downwardly offset lugs 21, 22, which are arranged to be received in an adjacent pair of openings 23 conventionally provided in the shelving material.

According to the invention, the base member 11 is configured so that its outer portion is in the form of a horizontal "U", with the upper portion 24 of the "U" forming an upper guide for the wire mounting portion 13 and the lower portion 25 of the "U", constituting a support for the lower end extremity 26 of the wire mounting portion. Also pursuant to the invention, the front wall 27 of the base member 11, has a tab-like portion 28 punched out in its center portion to provide a horizontally rearwardly directed lower guide portion for the wire mounting portion 13. The lower guide 28 is formed by a tab-like section, punched out on three sides from the front wall 27 of the base member, and bent over at right angles to project horizontally rearwardly from its lower edge 29 which remains integrally attached to the parent material. In the illustrated form of the invention, the width of the tab-like lower guide portion 28 may approximate one half inch, and its projecting length slightly less than that. It must be understood, of course, that specific dimensions themselves do not form part of the invention. They are merely used herein as examples to facilitate description and understanding of the invention.

Figure 2:
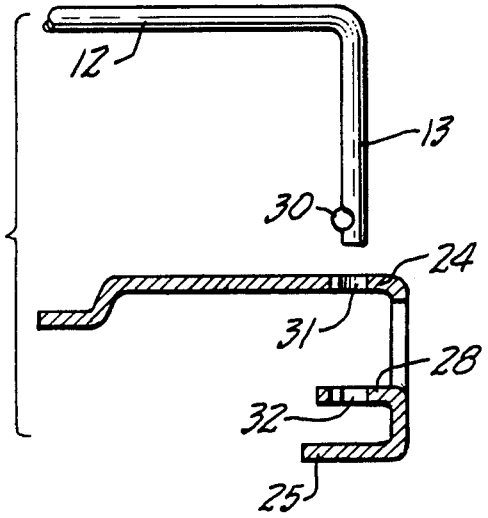
FIG. 2 is a fragmentary, exploded view of the device of FIG. 1, illustrating the manner of assembly of the hook to the base.

In accordance with the invention, the downwardly projecting mounting portion 13 of the display element is provided during its production with a staked "key" 30, which projects radially outward from the normally circular cross sectional configuration of the wire. The upper and lower guide portions 24, 28 of the base member are provided with keyhole-shaped openings 31, 32 of a size to closely receive the wire and its key 30, when the mounting portion 13 is properly rotationally oriented. In the illustrated arrangement, the key 30 normally projects in a forward direction, generally parallel to the merchandise support portion 12 of the hook, while the key-receiving portions 33 of the keyhole openings project rearwardly in the guide portions 24, 28 of the base member. Accordingly, for assembly of the hook to the base, the display element 10 is oriented rearwardly, as shown in FIG. 2, to line up the key 30 with the key-receiving portions 33. This allows the mounting portion 13 to be inserted into the aligned openings 31, 32, in order to assemble the wire together with the base.

Figure 3:
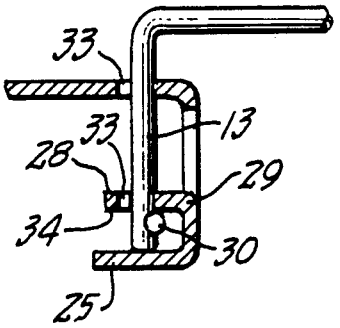
FIG. 3 is a view of the parts, shown in exploded configuration in FIG. 2, after assembly.

To particular advantage, the relative spacing between the upper guide portion 24, the lower guide portion 28 and the lower support portion 25 is arranged to maximize the space between the upper and lower guide portions 24, 28, in order to provide maximum support for the display element 10, while at the same time providing minimally adequate space between the lower guide portion 28 and the lower support portion 25 to receive that portion of the lower end of the wire-mounting portion 13 that contains the staked key element 30. Thus, as shown in FIGS. 1 and 3, the staked key 30 is located close to the lower end extremity of the mounting portion 13. The height of the lower guide portion 28 is just enough the support portion 25 to allow the key 30 to clear underneath the bottom surface 34 of the lower guide portion, after assembly of the elements 10, 11. If desired, the key 30 could be located slightly under the upper guide portion 24. However, from a manufacturing standpoint, it is preferred to position the key 30 near the end of the wire.

Figure 4:
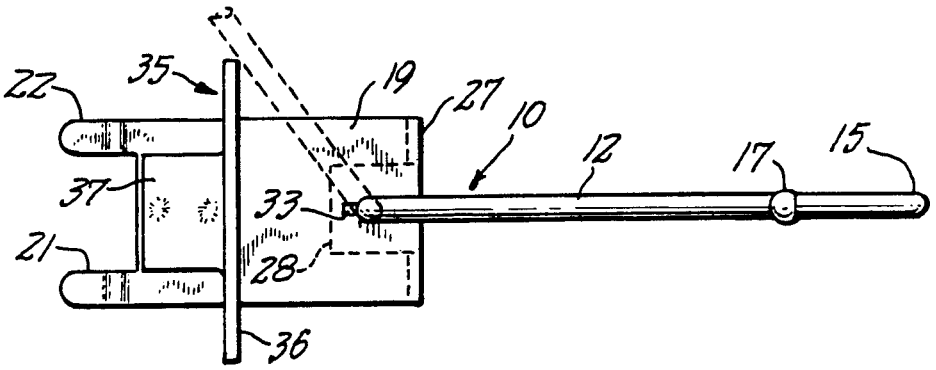
FIG. 4 is a top plan view of the hook of FIG. 1.

In the illustrated form of the invention, the initial assembly of the display element 10 and the base element 11 is rendered permanent by the permanent mounting on the top of the base support portion 19 of a label holder 35. The label holder 35 comprises a vertical, front-facing flat plate 36 connected integrally at its bottom with a horizontally, rearwardly extending base portion 37. The base portion 37 of the label holder is conveniently spot welded to the top of the body portion 19 as indicated in FIG. 4. When the label holder 35 is permanently mounted on the body portion 19, it is no longer possible for the merchandise display element 10 to be rotated to a position in which it can be disassembled from the base member. In some cases, where the label holder or other permanently mounted obstruction element is not employed, it may be adequate to rely upon the presence of merchandise cards, suspended from the display element, to prevent rotation of the element to a position enabling disassembly.

To advantage, the vertical length of the mounting portion 13 of the display element is greater than the vertical spacing between the upper guide portion 24 and the lower support portion 25, on which the wire rests. Accordingly, the merchandise support portion 12 of the display element is supported somewhat above the top of the base member. This provides for improved swivelling action, as well as improved aesthetics. In most cases, the display device will be mounted at the front edge of a shelf, in a location in which the wire-like display element projects out into the aisle used by customers. Accordingly, it is particularly desireable that the display element pivot easily to the side, in case of accidental contact with a person using the aisle space.

The device of the invention is especially useful from a safety standpoint, in that the normally exposed, projecting lower extremity of the vertical wire portion 13 is both supported and protected by the rearwardly directed support portion 25 of the base member. There is thus no opportunity for a customer, reaching underneath and behind the hook for retrieving merchandise, to be scratched or cut by the projecting wire end.

According to the invention, the lower guide portion 28 for the mounting portion 13 is formed by displacing a tab-like portion of the base member front wall 27, and bending it inwardly about its lower edge 29. The positioning of the lower guide portion 28 is such as to provide a relatively minimum spacing between it and the support portion 25. The spacing need be sufficiently only to allow the staked key 30 to pass below the guide portion 28 during the initial assembly.

It should be understood, of course, that the specific form of the invention herein illustrated and described is representative only, as certain changes may be made therein without departing from the clear teachings of the disclosure. Reference should be made to the following appended claims in determining the full scope of the invention.

I claim:

1. A two-part swivel hook assembly for the support and display of merchandise on a display fixture, which comprises (a) a metal wire display member having an outwardly extending portion for supporting merchandise and a downwardly extending mounting portion at its inner end for swivel mounting of the element, (b) a base member having means for mounting on a display fixture, (c) said base member comprising a section of sheet metal material shaped to form (i) generally horizontal upper guide portion, (ii) a front wall portion extending downwardly from the upper guide portion, (iii) a generally horizontal lower support portion extending rearwardly from said front wall portion, and (iv) a lower guide portion formed integrally with said front wall portion and extending generally horizontally rearward therefrom intermediate said upper guide member and said lower support portion, (d) said upper and lower guide portions having aligned openings therein for the reception of the downwardly extending mounting portion of said display member, (e) said mounting portion having a lower end portion provided with a radially extending key, (f) said aligned openings each having a radical slot therein for the reception of said key when said key is properly rotationally oriented relative to said openings, (g) said key being positioned between said lower guide portion and said support portion when said display member and said base member are in assembled relation, (h) said mounting having a lower end extremity and said support portion being positioned below and in alignment with said openings and engaging and supporting the lower end extremity of said mounting portion.

2. A swivel hook assembly according to claim 1, further characterized by (a) said lower guide portion comprising a tab-like portion punched out of said front wall portion and integrally joined therewith along the lower edge of said tab-like portion.

3. A swivel hook assembly according to claim 1, further characterized by (a) said key and said radial slots being oriented to require said display member during initial assembly to be rearwardly directed to effect assembly thereof with said base member, and (b) obstruction means on said base member preventing rearwardly directed orientation of said display member after initial assembly, whereby said parts are permanently assembled.

4. A swivel hook assembly according to claim 3, further characterized by (a) said obstruction means comprising a label holding plate mounted on said base member.

5. A two-part swivel hook assembly for the support and display of merchandise on a display fixture, which comprises (a) a metal wire display member having an outwardly extending portion for supporting merchandise and a downwardly extending mounting portion at its inner end for swivel mounting of the element, (b) a base member having means for mounting on a display fixture, (c) said base member comprising a section of sheet metal material shaped to form (i) a generally horizontal upper guide portion, (ii) a front wall portion extending downward from the upper guide portion,. (iii) a generally horizontal lower support portion extending rearwardly from said front portion, and (iv) a tab-like lower guide portion formed integrally with said front wall portion and extending generally horizontally rearward therefrom, (d) said guide portions having openings therein for receiving the mounting portion of said display element for swivelling movement about a generally vertical axis, (e) said mounting portion having a lower end extremity and said lower support portion being positioned in alignment with said openings and operative to engage and support the lower end extremity of said mounting portion, (f) said lower guide portion being positioned between and in vertically spaced relation to said upper guide portion and said support portion and being spaced from the support portion a smaller distance than from the upper guide portion, and (g) said mounting portion having a radial deformity therein positioned below one of said guide portions to prevent disassembly of said display element from said base member.

6. A swivel hook assembly according to claim 5, further characterized by (a) at least the upper guide portion of said base member having a radial slot extending therefrom for the reception of said radial deformity, whereby during initial assembly said mounting portion may be received in said base member only when said display member is in a predetermined radial orientation.

7. A swivel hook assembly according to claim 6, further characterized by (a) an obstruction member mounted on said base member and preventing said display member after initial assembly from being positioned in said predetermined orientation.

8. A swivel hook assembly according to claim 5, further characterized by (a) the length of said mounting portion being such as to support said outwardly extending portion at a level elevated above said upper guide portion.

* * * * *